US009399222B2

(12) United States Patent
Colson

(10) Patent No.: US 9,399,222 B2
(45) Date of Patent: Jul. 26, 2016

(54) AIR FLOW CONTROL ARRANGEMENT FOR PULVERIZER

(71) Applicant: ALSTOM Technology Ltd, Baden (CH)

(72) Inventor: Paul M. Colson, Southwick, MA (US)

(73) Assignee: ALSTOM TECHNOLOGY LTD, Baden (CH)

( * ) Notice: Subject to any disclaimer, the term of this patent is extended or adjusted under 35 U.S.C. 154(b) by 397 days.

(21) Appl. No.: 13/908,356

(22) Filed: Jun. 3, 2013

(65) Prior Publication Data

US 2014/0353411 A1 Dec. 4, 2014

(51) Int. Cl.
*B02C 15/04* (2006.01)
*B02C 15/00* (2006.01)

(52) U.S. Cl.
CPC ..... *B02C 15/001* (2013.01); *B02C 15/04* (2013.01)

(58) Field of Classification Search
CPC ..... B02C 23/18; B02C 15/001; B02C 15/04
USPC ..... 241/119
See application file for complete search history.

(56) References Cited

U.S. PATENT DOCUMENTS

| | | | | |
|---|---|---|---|---|
| 4,523,721 | A | 6/1985 | Maliszewski et al. | |
| 4,602,745 | A | 7/1986 | Maliszewski et al. | |
| 5,340,041 | A | 8/1994 | Henning et al. | |
| 5,549,251 | A * | 8/1996 | Provost | B02C 15/001 241/119 |
| 5,957,300 | A | 9/1999 | Nardi et al. | |
| 8,336,796 | B2 | 12/2012 | Wark | |
| 2008/0054112 | A1 | 3/2008 | Farris | |

FOREIGN PATENT DOCUMENTS

| | | |
|---|---|---|
| EP | 0 166 139 A2 | 1/1986 |
| SU | 587989 | 1/1978 |

* cited by examiner

*Primary Examiner* — Mark Rosenbaum
(74) *Attorney, Agent, or Firm* — GE Global Patent Operation; Stephen G. Midgley

(57) ABSTRACT

An air flow control arrangement for a pulverizer includes an inner ring segment, an outer ring segment, a plurality of vanes, and a plurality of vanes. The inner and outer ring segments are adaptably configured in a spaced relation to each other. Further, the plurality of vanes is spaced apartly arranged between the inner and outer ring segments to form flow ducts. Furthermore, each wingtip of the plurality of wingtip is detachably attached to a respective vane of the plurality of vanes to be adaptably replaceable or changeable.

11 Claims, 8 Drawing Sheets

AIR FLOW CONTROL ARRANGEMENT FOR PULVERIZER

BACKGROUND

The present disclosure relates to a field of coal pulverizers, and, more particularly, to air flow control arrangement in a roll to race coal pulverizer.

An air flow control arrangement, which is also generally known as a rotating throat, airport or vane wheels, in a pulverizer configures air ducts for directing controlled air flow into a pulverizer grinding zone of the pulverizer to aid in efficient pulverization and drying of coal along with the removal of the pyrites.

Typically, a configuration of such arrangement includes inner and outer rings and various vanes arranged spaced-apart relation between the outer and inner rings. The inner ring is engaged to the pulverizer grinding zone and the outer ring is welded to the inner ring in coordination with the various vanes. Further, for velocity control and calibration of the air flow, a wingtip is also welded with each respective vane between the inner and outer rings.

Welded engagement between the inner and outer rings in coordination with the vanes and wingtips are generally problematic in terms of changeover of the arrangement or individual parts thereof from the pulverizer and from each other in case of wear and tear.

Such conventional designs may be quite in practice, and may have generally been considered satisfactory for their intended purposes, but may be unsatisfactory in terms of changeability in economical and convenient manner as in case of wear and tear.

Accordingly, there exists a need to improve air flow control arrangement to preclude or minimize various associated problems in an economical and adaptable manner.

SUMMARY

The present disclosure describes air flow control arrangement in a roll to race coal pulverizer, that will be presented in the following simplified summary to provide a basic understanding of one or more aspects of the disclosure that are intended to overcome the discussed drawbacks, but to include all advantages thereof, along with providing some additional advantages. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter.

An object of the present disclosure is to describe an air flow control arrangement in a roll to race coal pulverizer, which may be adaptable in terms of changeability in economical and convenient manner in case of wear and tear from the pulverizer. Various other objects and features of the present disclosure will be apparent from the following detailed description and claims.

The above noted and other objects, in one aspect, may be achieved by an air flow control arrangement for a pulverizer. Examples of the pulverizer, where such arrangement may be utilized, including but not limited to, roll to race coal pulverizer. While the disclosure will be described in conjunction with the roll to race pulverizer for the purpose of better understanding, the scope of the disclosure will extend to all such components where the present arrangement method may be successfully utilized.

According to the above aspects of the present disclosure, an air flow control arrangement for a pulverizer is described. An air flow control arrangement includes inner and outer ring segments, a plurality of vanes and a plurality of wingtips. The inner and outer ring segments are adaptably configured in a spaced relation to each other. Further, the plurality of vanes is spaced apartly arranged between the inner and outer ring segments to form various flow ducts. Furthermore, each wingtip of the plurality of wingtip is detachably attached to a respective vane of the plurality of vanes to adaptably replaceable or changeable.

In one embodiment, each of the plurality of vanes includes a flange extending transversely from a top portion thereof. The flange is capable of detachably adapting the respective wingtip thereon. The wingtip may be detachably attached to the respective flange of the respective vane via a detachable attachment, such as fasteners.

In one embodiment, the inner and outer ring segments may be adaptably configured as one piece structure, such that the plurality of vanes extends radially outward from the inner ring segment and ends at the outer ring segments.

In another embodiment, the inner and outer ring segments may be adaptably configured as two piece structure, such that the outer ring segment is detachably attachable to the inner ring segment, and in such embodiment, the plurality of vanes extends radially outward from the inner ring segment. Such two piece structure, are detachably attachable via at least one detachable configuration, for example protrusion-recess combination.

In one embodiment of the present disclosure, the air flow control arrangement includes a visual wear indicator configured on at least one of the outer ring segments and the plurality of vanes.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawing, wherein like elements are identified with like symbols, and in which:

Like reference numerals refer to like parts throughout the description of several views of the drawings.

DETAILED DESCRIPTION OF THE PRESENT DISCLOSURE

For a thorough understanding of the present disclosure, reference is to be made to the following detailed description, including the appended claims, in connection with the above described drawings. In the following description, for purposes of explanation, numerous specific details are set forth in order to provide a thorough understanding of the present disclosure. It will be apparent, however, to one skilled in the art that the present disclosure can be practiced without these specific details. In other instances, structures and apparatuses are shown in block diagrams form only, in order to avoid obscuring the disclosure. Reference in this specification to "one embodiment," "an embodiment," "another embodiment," "various embodiments," means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but may not be of other embodiment's requirement.

Although the following description contains many specifics for the purposes of illustration, anyone skilled in the art will appreciate that many variations and/or alterations to these details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure. Further, the relative terms, such as "first," "second," "inner," "outer" and the like, herein do not denote any order, elevation or importance, but rather are used to distinguish one element from another. Further, the terms "a" and "an" herein do not denote a limitation of quantity, but rather denote the presence of at least one of the referenced item.

Figure 1:
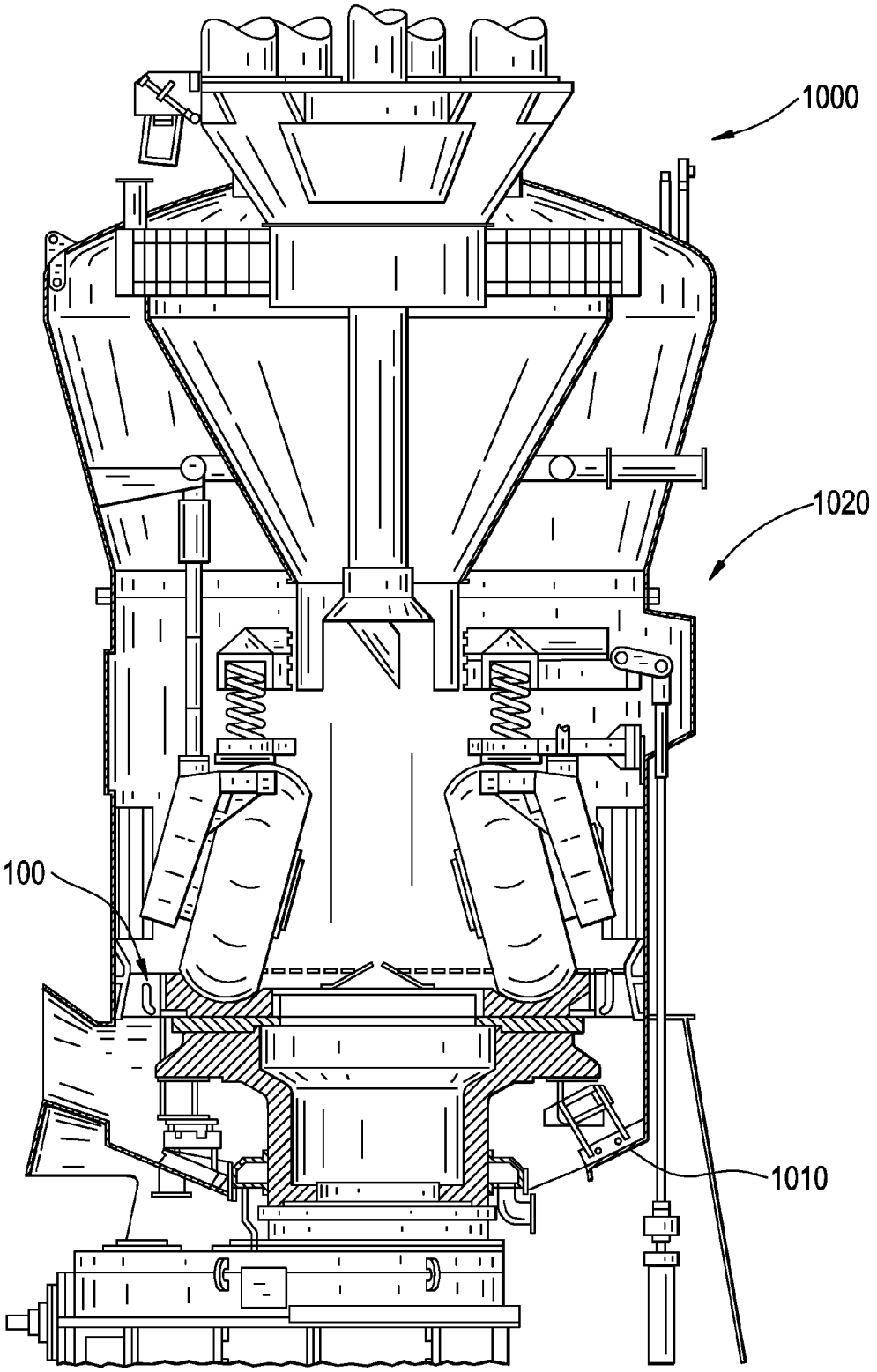
FIG. 1 illustrates an example front view of a pulverizer, in accordance with an exemplary embodiment of the present disclosure.
Figure 2:
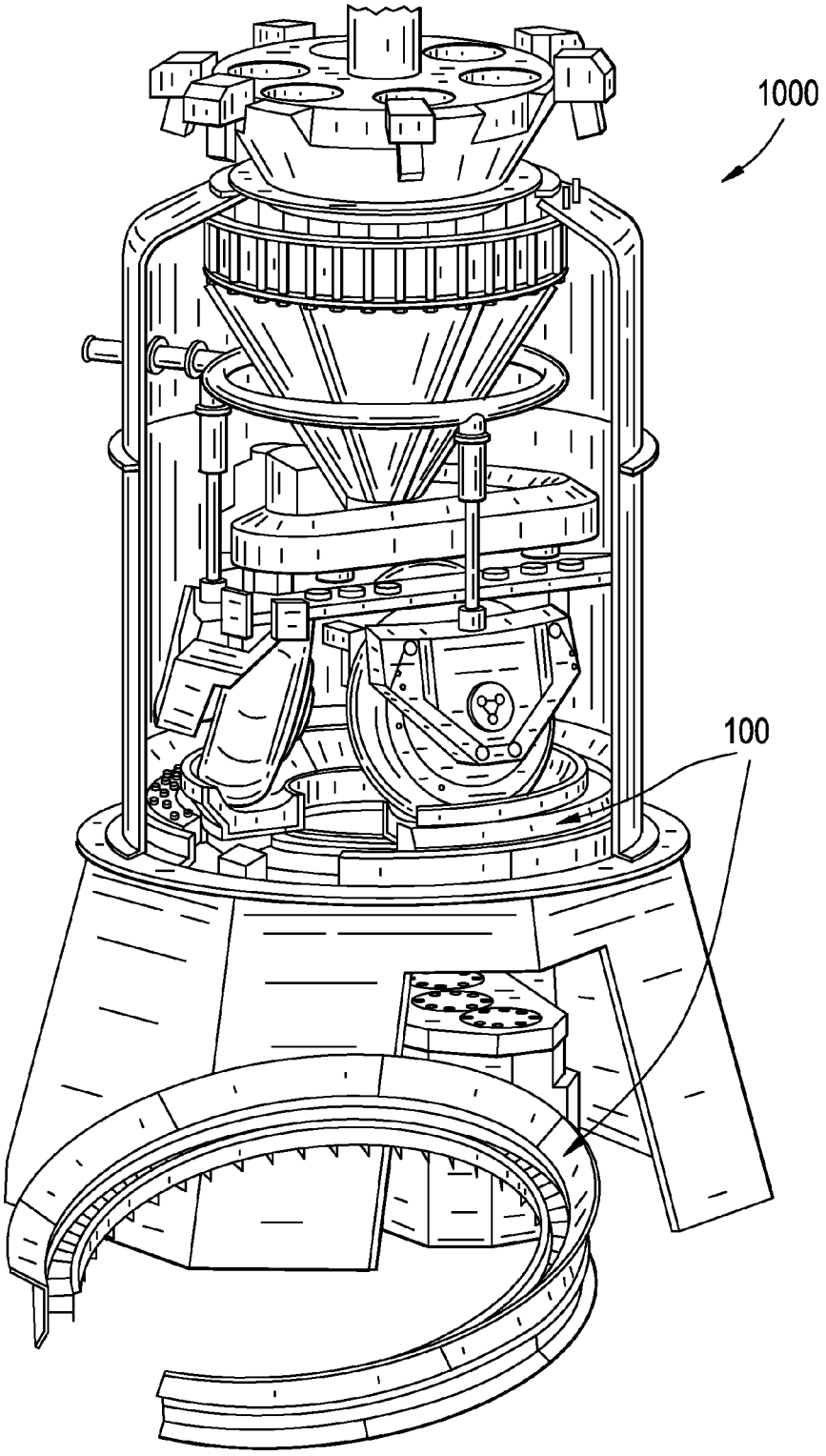
FIG. 2 illustrates an example perspective view of an air flow control arrangement of FIG. 1, whereby an air flow control arrangement is shown separately, in accordance with an exemplary embodiment of the present disclosure.
Figure 3B:
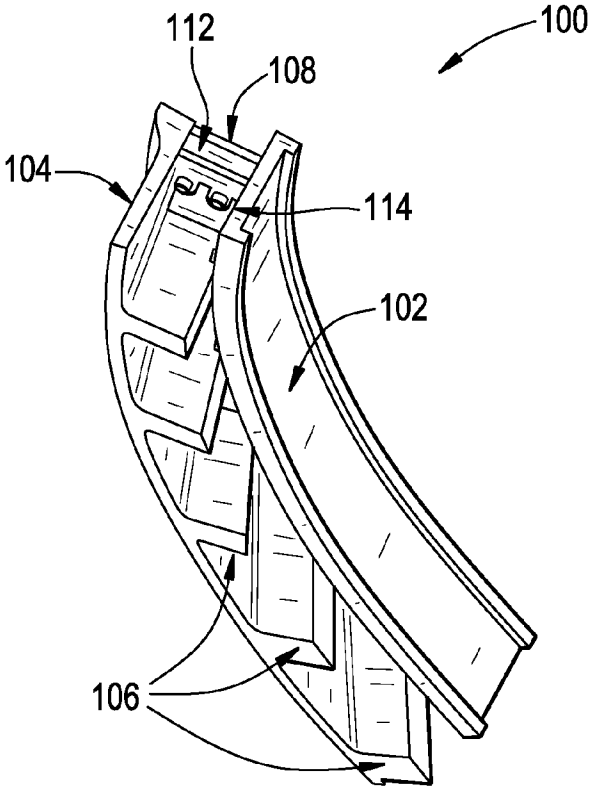
FIGS. 3A to 3C illustrate various views of the air flow control arrangement of FIG. 2, in accordance with an exemplary embodiment of the present disclosure.
Figure 3A:
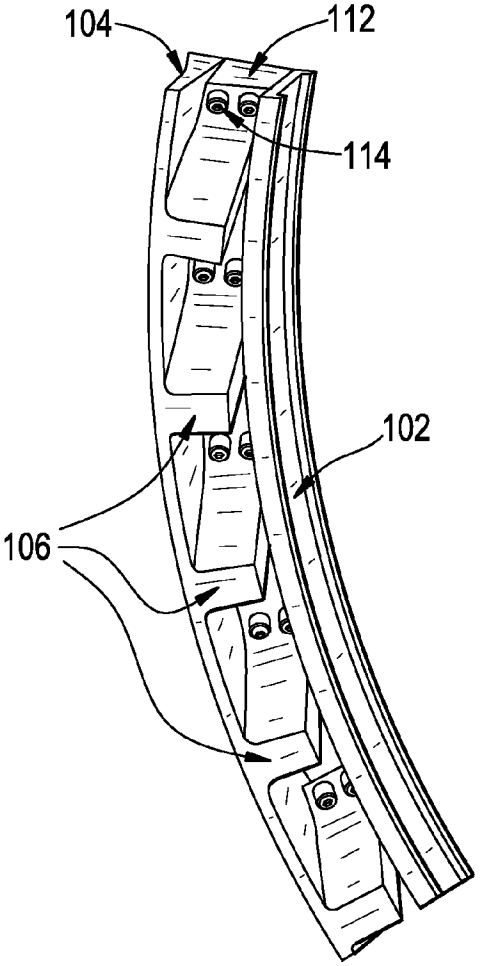
Figure 3C:
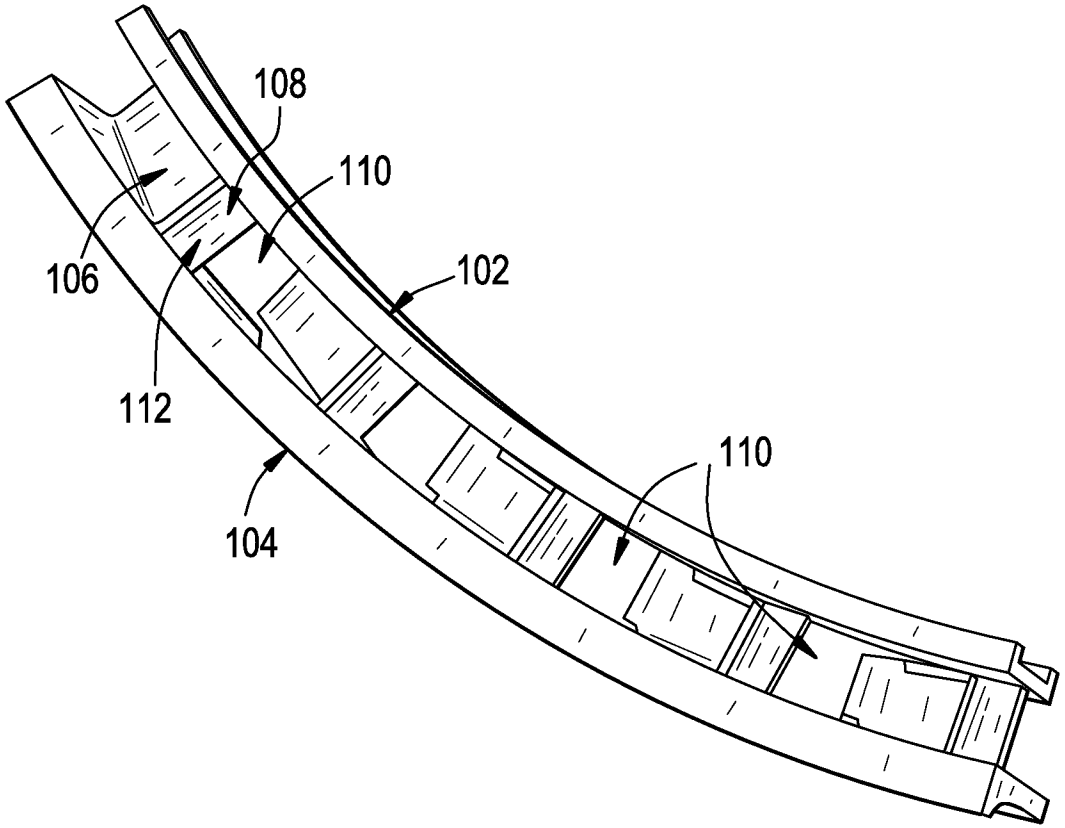
Figure 4A:
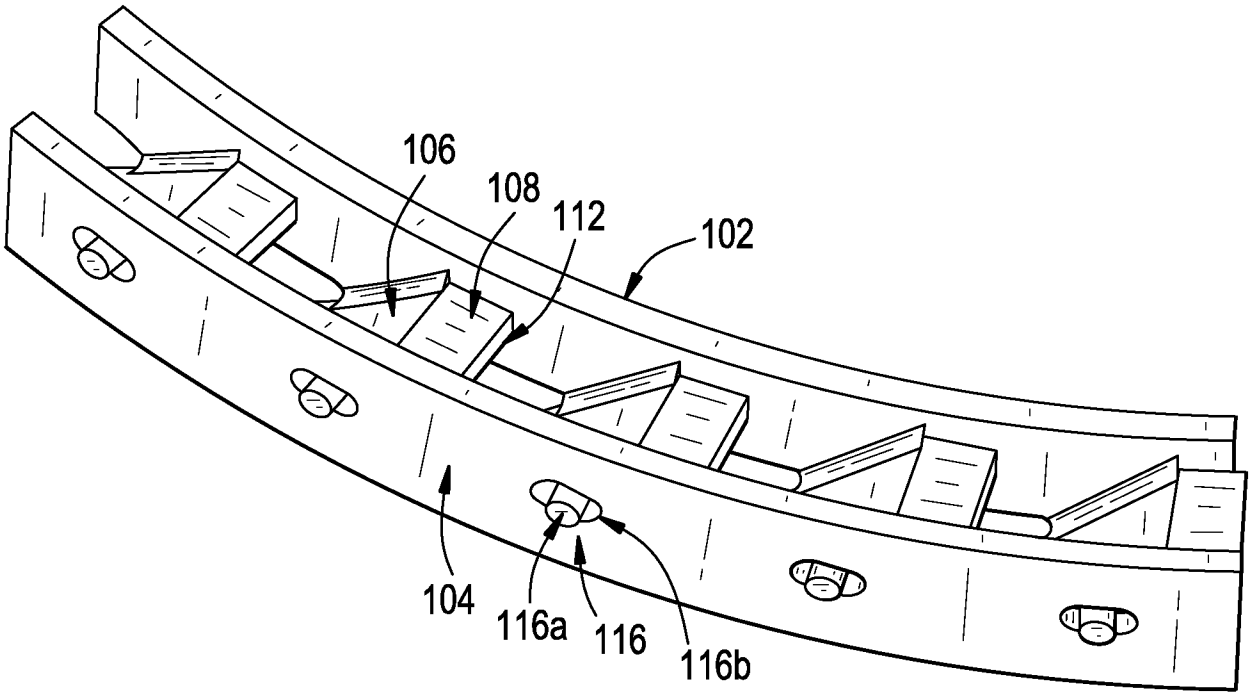
FIGS. 4A to 4C illustrate various views of the air flow control arrangement of FIG. 2, in accordance with another exemplary embodiment of the present disclosure.
Figure 4B:
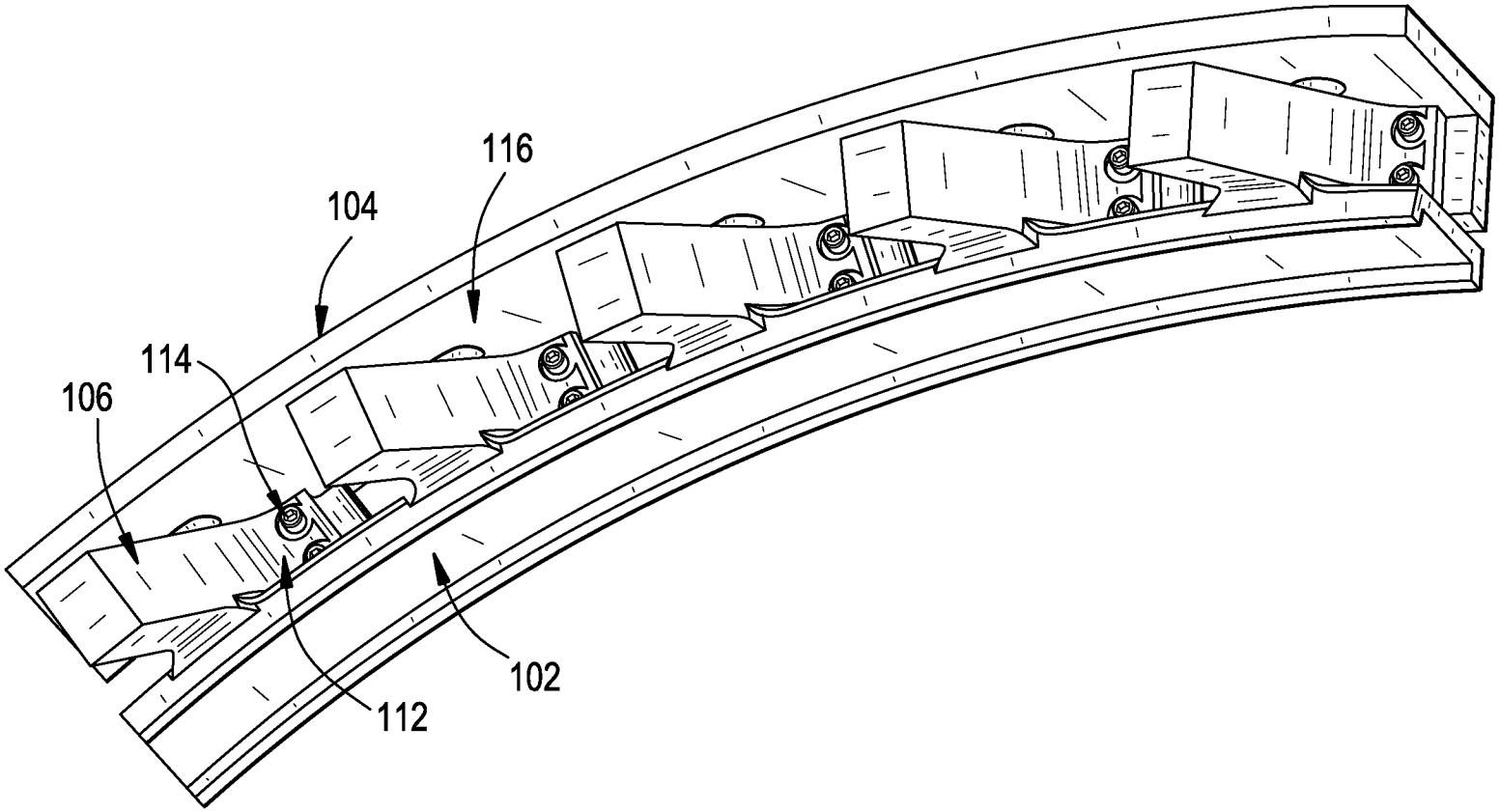
Figure 4C:
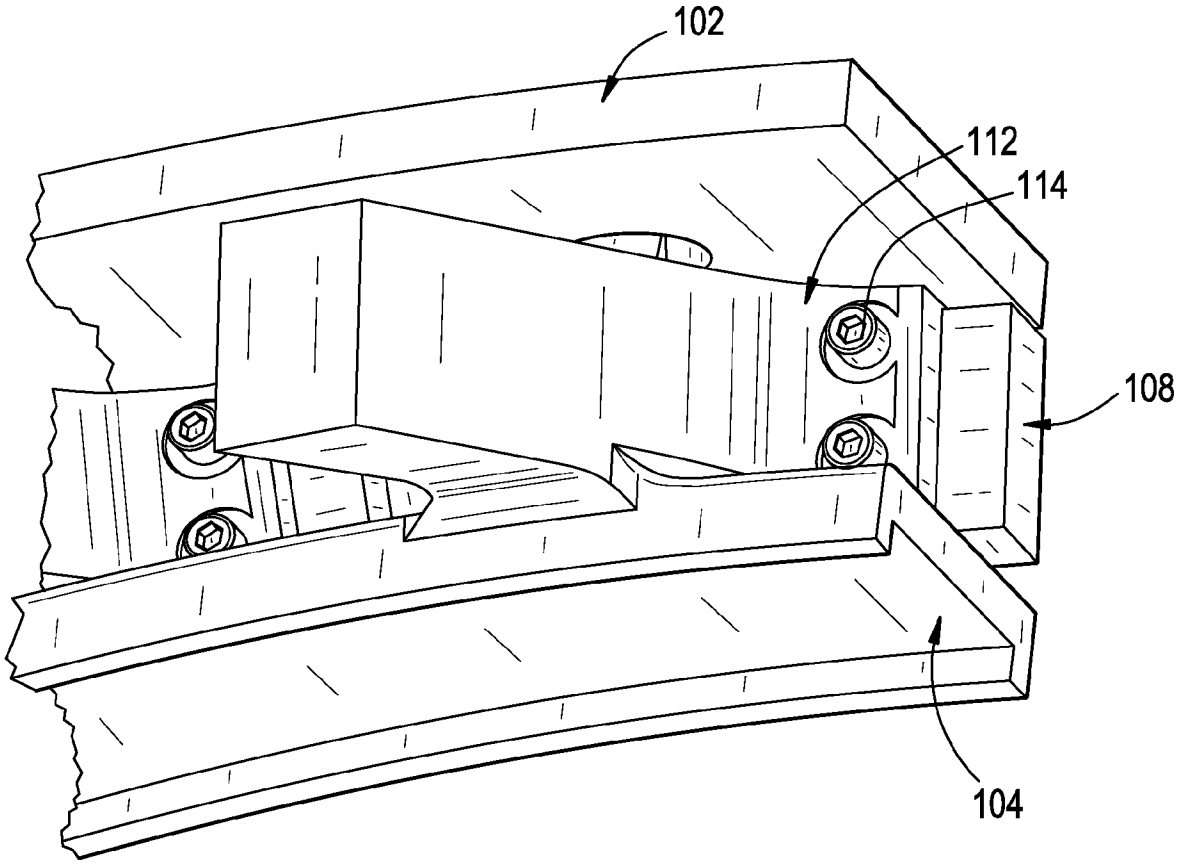
Figure 5:
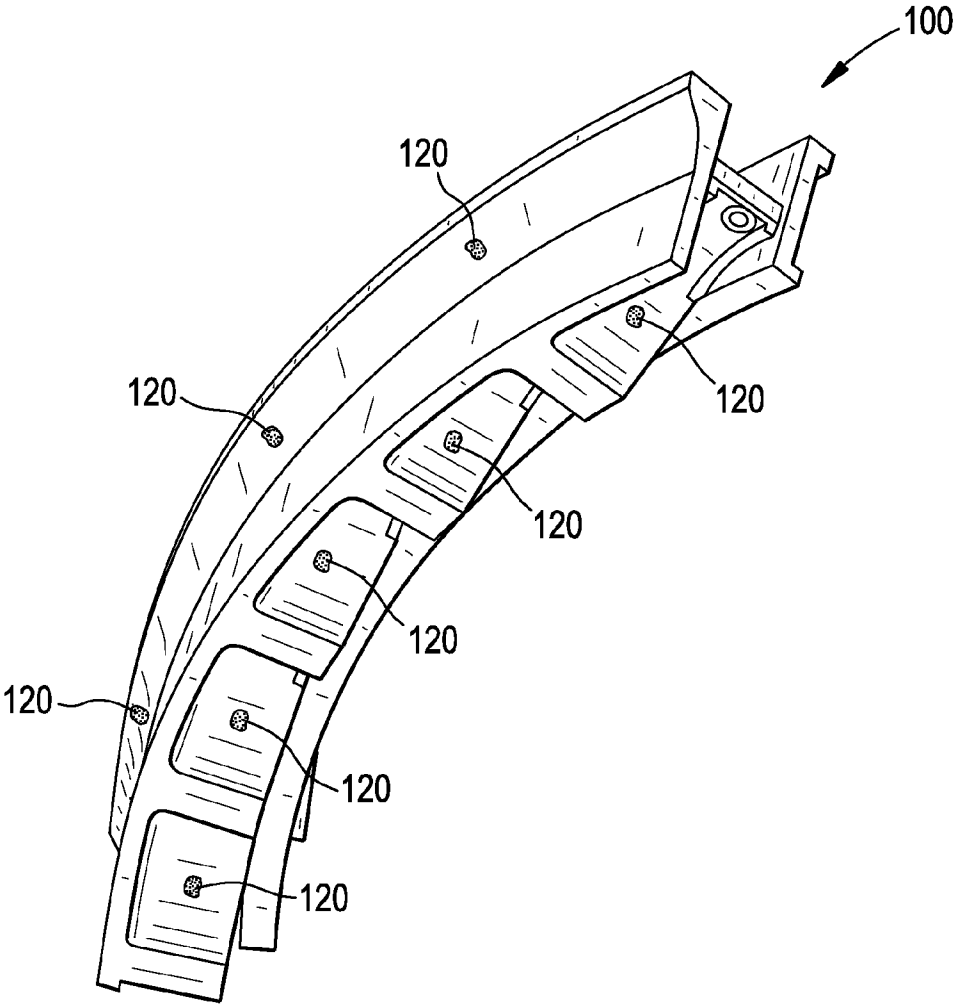
FIG. 5 illustrates an example perspective view of the air flow control arrangement with a visual wear indicator, in accordance with an exemplary embodiment of the present disclosure.

Referring now to FIGS. 1 to 4C, various views of an example of an air flow control arrangement 100 for a pulverizer 1000, such as a roll to race pulverizer, are illustrated in accordance with an exemplary embodiment of the present disclosure. FIGS. 1 and 2 illustrate front and perspective views of the pulverizer 1000, whereas FIGS. 3A to 3C illustrate various views of the air flow control arrangement 100 of the pulverizer 1000, according to one embodiment of the present disclosure. Further, FIGS. 4A to 4C illustrate various views of the air flow control arrangement 100 of the pulverizer 1000, according to another embodiment of the present disclosure. Further, FIG. 5 illustrates the air flow control arrangement 100 with a visual wear indicator. In as much as the construction and arrangement of the air flow control arrangement 100 and pulverizer 1000, various associated elements may be well-known to those skilled in the art, it is not deemed necessary for purposes of acquiring an understanding of the present disclosure that there be recited herein all of the constructional details and explanation thereof. Rather, it is deemed sufficient to simply note that as shown in FIGS. 1 to 4, in the air flow control arrangement 100, only those components are shown that are relevant for the description of various embodiments of the present disclosure.

As shown in FIGS. 1 and 2, the pulverizer 1000 is disclosed. In the pulverizer 1000, the air flow control arrangement 100 of the present disclosure is configured for directing controlled air flow from a side assembly 1010 of the pulverizer into a pulverizer grinding zone 1020 of the pulverizer 1000 to aid in efficient pulverization and drying of coal along with the removal of the pyrites.

Referring to FIGS. 3A to 3C, the air flow control arrangement 100 includes an inner ring segment 102, an outer ring segment 104, a plurality of vanes 106 and a plurality of wingtips 108. The inner ring segment 102 may be adapted to be engaged to the pulverizer grinding zone 1020 for engaging the air flow control arrangement 100 with the pulverizer 1000, as shown in FIGS. 1 and 2. The outer ring segment 104 is adapted to be attached to the inner ring segment 102 in a spaced relation. The plurality of vanes 106 are spaced apartly arranged in a slanted manner between the inner and outer ring segments 102, 104, in an extending manner from the inner ring segment 102 towards the outer ring segment 104, to form flow ducts 110, as shown in FIG. 3C. The flow ducts 110 are capable of directing air flow into the pulverizer grinding zone 1020 of the pulverizer 1000 to aid in efficient pulverization and drying of coal along with the removal of the pyrites.

Further, each of the plurality of vanes 106 adaptably configures a respective wingtip 108 between the inner and outer ring segments 102, 104. Particularly, each of the plurality of vanes 106 includes a flange 112 extending transversely from a top portion of the respective vanes 106. Each respective flange 112 of the plurality of the vanes 106 is capable of detachably adapting the respective wingtip 110 thereon for controlling the velocity of the air flow into the pulverizer grinding zone 1020 of the pulverizer 1000 to aid in efficient pulverization and drying of coal along with the removal of the pyrites.

Each respective wingtip 110 is capable of being detachably attached to the respective flange 112 of the respective vane of the plurality of vanes 106 via a detachable attachment 114. In one embodiment, the detachable attachment 114 may be a suitable fastener.

Further, in one embodiment of the present disclosure, as shown in FIGS. 3A to 3C, the inner and outer ring segments 102, 104 are adaptably configured as one-piece structure. In such embodiment, each of the plurality of primary vanes 106 is configured to extend radially outward from the inner ring segment 102 and ends at the outer ring segment 104.

In another embodiment, as shown in FIGS. 4A to 4C, the inner and outer ring segments 102, 104 may be adaptably configured as two-piece structure. In such embodiment, the outer ring segment 102 may be detachably attachable to the inner ring segment 104. Further, in this embodiment, the plurality of vanes 106 extends radially outward from the inner ring segment 102, and the outer ring segment 104 is free to be detachably attached to the inner ring segment 102 via a detachably configuration 116. The detachable configuration 116, in one embodiment, may include a protrusion 116*a* extending from the inner ring segments 102; and a recess 116*b* configured on the outer ring segment 104. The recess 116*b* may detachably receive the protrusion 116*b* for configuring the detachable configuration 116 to adaptably configure the two piece structure of the air flow control arrangement 100. However, without departing from the scope of the present disclosure, the detachable configuration 116 may be any other known coupling means that configure two-piece structure.

The air flow control arrangement 100, in one embodiment of the present disclosure, may include a visual wear indicator 120. The air flow control arrangement 100 with the visual wear indicator 120 is depicted in FIG. 5. The visual wear indicator 120 may be configured on at least on the outer ring segment 104 or on the plurality of wingtips 108 or on both at various places or at any suitable place. The visual wear indicator 120 is capable of providing a visual indication to a user or worker on the pulverizer 1000 to easily identify replacement of worn-out parts.

For replacement of the worn-out part, i.e., the outer ring segment 104 from the air flow control arrangement 100, the protrusion 116*b* and recess 116*b* may be detached. Thereafter, as per the requirement, a new outer ring segments 104 may be configured with the inner ring segment 102 for configuring the flow ducts 108 as described above in two-piece structure. Further, the worn-out part, i.e., the wingtips 108 may also be replaced by releasing the detachable attachment 114, such as the fastener, from the one-piece as well as two-piece structures of the air flow control arrangement 100.

The air flow control arrangement of the present disclosure is advantageous in various scopes. The air flow control arrangement may be adaptable in terms of changeability in economical and convenient manner in case of wear and tear from the pulverizer. It is also advantageous in quick change and installation of worn-out wingtips through fasteners. Further, visual wear indicating features indicate when parts are at the end of the wear life providing worker or user of the pulverizer machine to easily recognize the parts to be replaced. Various other advantages and features of the present disclosure are apparent from the above detailed description and appendage claims.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An air flow control arrangement for a pulverizer, the air flow arrangement comprising:

inner and outer ring segments configured in a spaced relation to each other;

a plurality of vanes arranged between the inner and outer ring segments to form flow ducts; and a plurality of wingtips, wherein each wingtip of the plurality of wingtips is removably attached to a respective vane of the plurality of vanes such that each wingtip is selectively replaceable;

wherein the inner and outer ring segments are configured as a two-piece structure such that the outer ring segment is removably attachable to the inner ring segment, and wherein the plurality of vanes extends radially outward from the inner ring segment; and wherein an outer wall of the inner ring and an inner wall of the outer ring define inner and outer walls, respectively, of the flow ducts.

2. The air flow control arrangement as claimed in claim 1, wherein each of the plurality of vanes extends radially outward in slanted manner from the inner ring segment towards the outer ring segment.

3. The air flow control arrangement as claimed in claim 1, wherein each of the plurality of vanes comprises:

a flange extending transversely from a top portion thereof, wherein the flange receives the respective wingtip thereon.

4. The air flow control arrangement as claimed in claim 3, wherein the wingtip is attached to the respective flange of the respective vane of the plurality of vanes via a detachable attachment.

5. The air flow control arrangement as claimed in claim 4, wherein the detachable attachment is a fastener.

6. The air flow control arrangement as claimed in claim 1, wherein the inner and outer ring segments, in the two-piece structure, are attachable to one another via at least one detachable configuration.

7. The air flow control arrangement as claimed in claim 6, wherein the at least one detachable configuration comprises:

a protrusion extending from the inner ring segment; and a recess configured on the outer ring segment to detachably receive the protrusion.

8. The air flow control arrangement as claimed in claim 1, further comprising a visual wear indicator configured on at least one of the outer ring segment and the plurality of wingtips.

9. An air flow control arrangement for a pulverizer, the air flow arrangement comprising:

an inner ring segment;

an outer ring segment, the inner and outer ring segments being configured in a spaced relation to each other;

a plurality of vanes extending between the inner ring segment and the outer ring segment to form a plurality of flow ducts, each of the vanes having a flange extending from a top portion of each vane; and a plurality of wingtips, wherein each wingtip of the plurality of wingtips is releasably attached to a respective flange of a respective vane of the plurality of vanes and extends at least partially over a respective flow duct of the plurality of flow ducts.

10. The air flow control arrangement as claimed in claim 9, further comprising:

a visual wear indicator configured on at least one of the plurality of wingtips.

11. The air flow control arrangement as claimed in claim 9, further comprising:

a visual wear indicator configured on the outer ring segment.

* * * * *